US006546648B2

(12) United States Patent
Dixon

(10) Patent No.: US 6,546,648 B2
(45) Date of Patent: Apr. 15, 2003

(54) ATHLETIC SHOE WITH STABILIZED DISCRETE RESILIENT ELEMENTS IN HEEL

(76) Inventor: Roy Dixon, 230 Las Pal Mas St., Royal Palm Beach, FL (US) 33411

( * ) Notice: Subject to any disclaimer, the term of this patent is extended or adjusted under 35 U.S.C. 154(b) by 0 days.

(21) Appl. No.: 09/882,331

(22) Filed: Jun. 18, 2001

(65) Prior Publication Data

US 2002/0189134 A1 Dec. 19, 2002

(51) Int. Cl.[7] ..... A43B 13/14; A43B 13/18

(52) U.S. Cl. ..... 36/25 R; 36/27; 36/28; 36/35 R; 36/59 A

(58) Field of Search ..... 36/25 R, 27, 28, 36/35 R, 59 A

(56) References Cited

U.S. PATENT DOCUMENTS 1,380,825 A * 6/1921 Monnett et al.
4,616,431 A * 10/1986 Dassler
4,715,130 A * 12/1987 Scatena
5,224,278 A * 7/1993 Jeon
5,353,523 A * 10/1994 Kilgore et al.
5,544,431 A * 8/1996 Dixon

* cited by examiner

*Primary Examiner*—Ted Kavanaugh
(74) *Attorney, Agent, or Firm*—M. K. Silverman

(57) ABSTRACT

An athletic shoe includes substantially horizontal chamber substantially within a heel portion of a midsole, the chamber having atmospheric communication at its lateral sides. The chamber includes an upper substantially rigid horizontal plate having at least four apertures therein and a lower substantially rigid horizontal support plate having a corresponding plurality of at least four apertures. Flexible resilient unitary sleeves integrally join respective vertical pairs of the apertures of the upper and lower plates respectively. Disposed within each of the resilient sleeves are resilient members each having spring constant and spring rate greater than that of the sleeves.

5 Claims, 8 Drawing Sheets

ATHLETIC SHOE WITH STABILIZED DISCRETE RESILIENT ELEMENTS IN HEEL

BACKGROUND OF THE INVENTION

1. Area of Invention

The instant invention relates to athletic shoes having resilient springs, or spring equivalents, within the heel thereof.

2. Prior Art

The instant invention comprises an improvement of my U.S. Pat. No. 5,544,431 (1996) entitled Shock Absorbing Shoe with Adjustable Insert and also comprises an improvement over the invention of U.S. Pat. No. 5,343,639 (1994) to Kilgore, et al, entitled Shoe with Improved Midsole and over U.S. Pat. No. 6,006,449 (1999) to Orlowski, et al entitled Footwear Having Spring Assemblies In the Insoles Thereof.

Numerous patents exist in the field of footwear. Therein, a primary purpose thereof is to protect the foot from injury. Further, the sole of the shoe provides traction and cushioning. In the context of an athletic shoe, various attempts have been made in the prior art to incorporate a spring, a spring module, or spring equivalent into either or both the heel or forefoot thereof. However, spring based athletic shoes of the past were mainly novelty products having an unpredictable platform that would react unpredictably to various forces provided, this in direct relation to the impact applied by the heel of the foot to the spring, spring module or spring equivalent. Accordingly, a primary problem in the incorporation of springs into the heel of a shoe has been that of controllability thereof.

U.S. Pat. No. 5,282,325 discloses a sport shoe having a spring disposed in the sole of the shoe in which the spring operates to provide bias to the foot in a raised position and cushioning of the shoe against shock from the ground. The spring employed therein is a torsion spring positional along the longitudinal axis disposed horizontal to the ground and using the spring constant to resist flexing of the spring. The above referenced U.S. patent to Kilgore provides an improved midsole and heel utilizes a group of hollow cylindrical columns within the heel portion and, therein, the use of either gas bladders of a micro-cellular foam-like material therein to provide a desired degree of stiffness to the respective columns responsive to impact thereupon. Given the essentially passive nature of the air bladder or micro cellular supported columns of said system, the end result is a shoe having improved cushioning but, however, lacking the requisite degree of resilient spring-action for use in certain sports such as basketball.

In my said U.S. Pat. No. 5,544,431 (1996) is described a shock absorbing adjustable insert for use within the heel of the sole which comprises a spring module system having particular value in certain activities such as basketball and other jumping sports. Therein, the spring action operates as a shock absorber for the foot and provides an accelerating spring action following the compression which precedes any jumping motion of an athlete. The instant invention may, thereby, be viewed as an integration of the spring and spring platform support features of my said U.S. Pat. No. 5,544,431 with the use of compressible vertical columns as is taught by said Kilgore. Additionally, the instant invention reflects a recognition that, given the existence of contemporary high impact, high resilient polymeric materials, a considerable range of spring equivalence exists which, in terms of both spring constant and spring rate, can behave in a comparable yet more controllable fashion than classical springs.

SUMMARY OF THE INVENTION

My invention relates to an athletic shoe having stabilized discreet resilient elements substantially within a horizontal chamber substantially within a heel portion of a midsole thereof, said chamber having atmospheric communication at lateral sides thereof. The improvement more particularly comprises (a midsole chamber having an upper substantially rigid horizontal plate with at least four apertures therein) a lower substantially rigid horizontal support plate with a corresponding plurality of at least four apertures therein. Also provided are flexible resilient unitary sleeves integrally joining respective vertical pairs of said apertures of said upper and lower plates respectively. Yet further provided are solid resilient means disposed within each of said sleeves, said resilient means each having a greater spring constant and spring rate than that of said resilient sleeves, whereby directionality of said spring rate is controlled by said sleeves. Means are provided for securing said horizontal chamber between upper and lower soles of the shoe.

It is accordingly a primary object of the present invention to provide an athletic shoe adapted to relieve shock loads experienced by the wearer and to maximize the spring effect of the heel thereof.

It is another object to provide an improved athletic shoe using spring elements or spring element equivalents having improved stability relative to shoe components above and below such elements.

It is a further object of the invention to provide an athletic shoe particularly adapted for use in basketball and other jumping sports.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
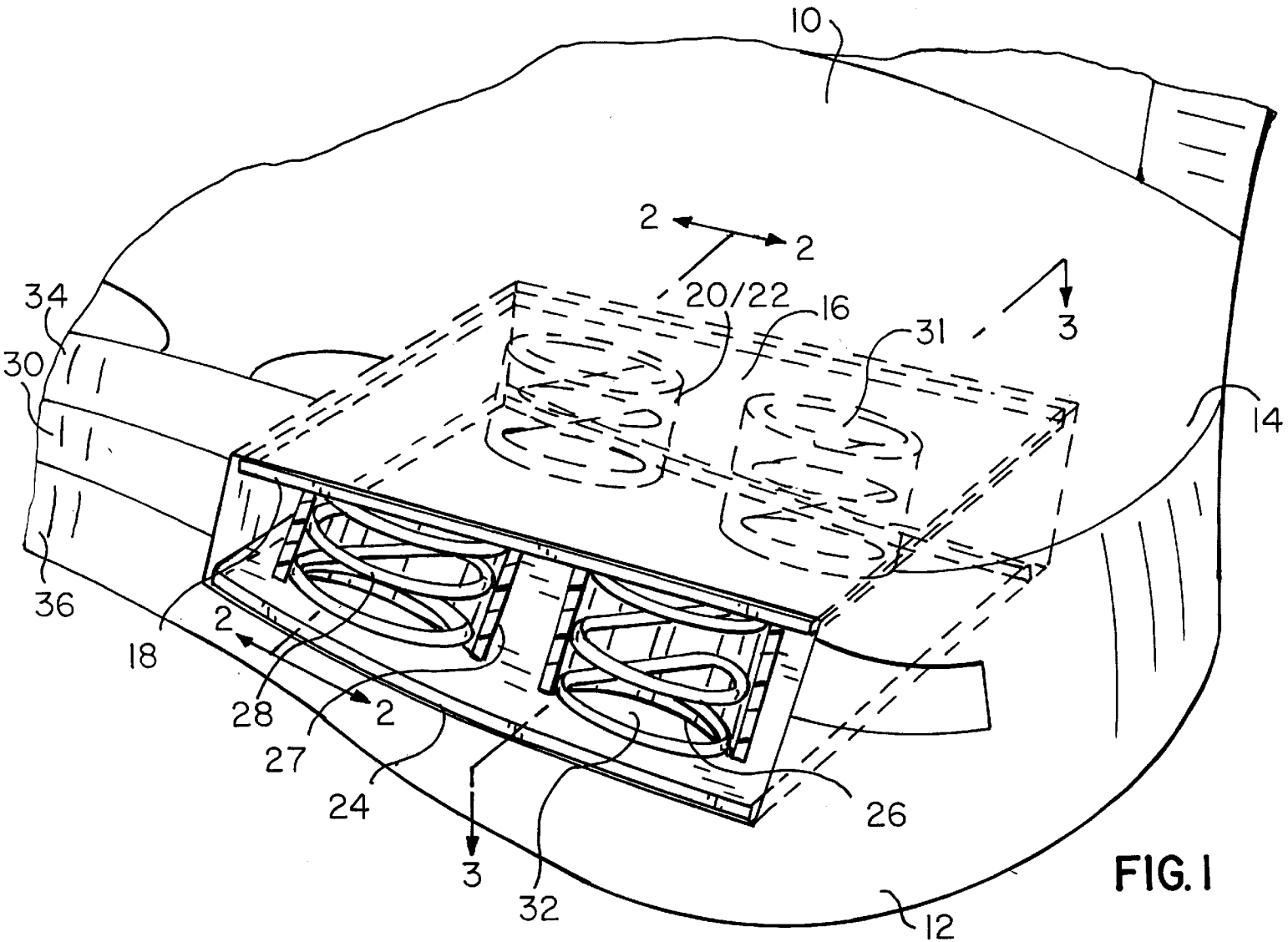
FIG. 1 is a perspective breakaway schematic view of a first embodiment of the invention showing the inventive midsole chamber of the athletic shoe, showing the use of spring elements.

With reference to the perspective breakaway view of FIG. 1, the inventive athletic shoe may be seen to include an upper portion 10 forming a covering for insertion of a foot and a lower portion, typically referred to as a sole 12, secured to said upper portion for support of the base of the foot. Sole 12 comprises an upper sole 34, a midsole 30, and a lower sole 36. Securement of upper portion 10 to upper sole 34 occurs along an interface 14. Below this interface and within the midsole 30 is formed a substantially horizontal chamber 16 having atmospheric communication at the lateral sides thereof. A horizontal chamber of this type, however, is one having a greater ratio of height-to-length is taught in my above referenced U.S. Pat. No. 5,544,431. Said horizontal chamber 16, exhibits a ratio of longitudinal length to vertical height of approximately 4 to 1. Therein is disposed an upper substantially rigid horizontal support plate 18 having therein a plurality of transverse downwardly directed cavities 20. Said cavities are defined by a corresponding plurality of upper resilient sleeves 22. See FIG. 8.

Figure 3:
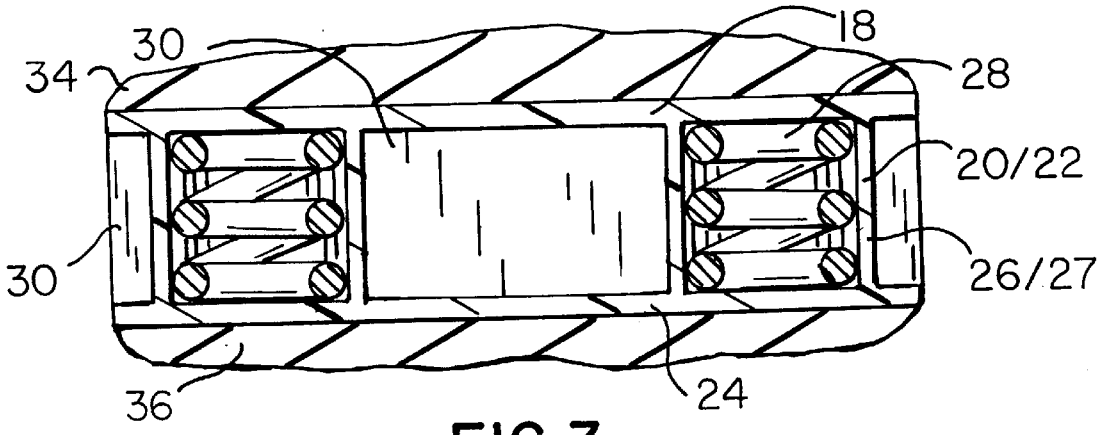
FIG. 3 is a vertical cross-sectional view taken through Line 3—3 of FIG. 1.
Figure 3A:
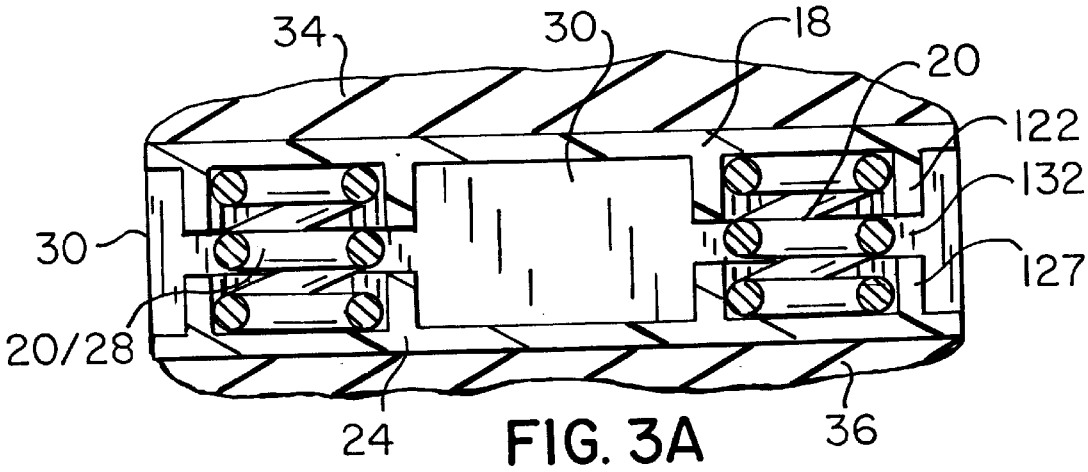
Figure 5:
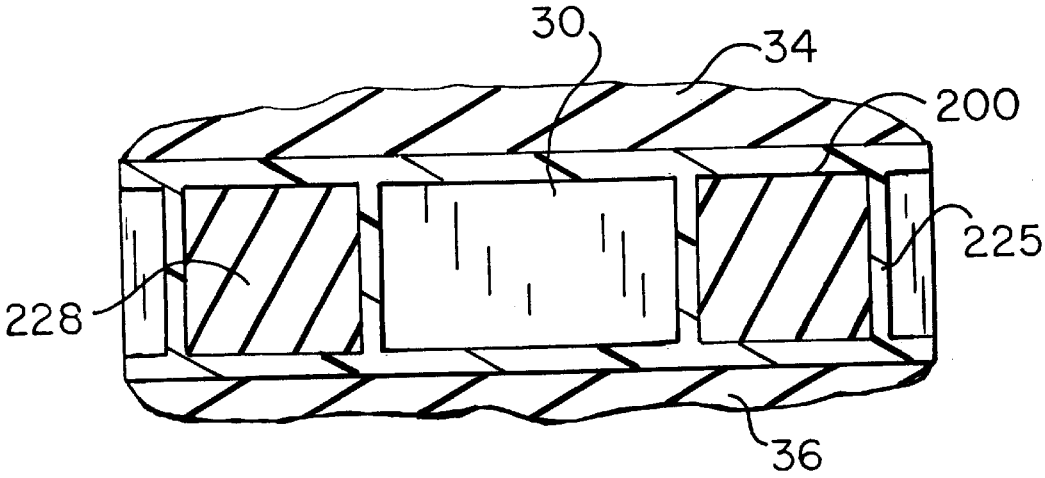
FIG. 5 is a vertical cross-sectional view taken along Line 5—5 of FIG. 4.

Further provided is a lower substantially rigid horizontal plate 24 having a plurality of transverse upwardly directed cavities 26 therein, which are defined by respective lower resilient sleeves-27. Where said upper and lower sleeves 22 and 27 respectively are more flexible than resilient means 28 that are disposed within an aggregate of upper and lower cavities 20 and 26. Said upper and lower sleeves may assume the form of a single continuous sleeve 25 as is shown in FIGS. 1, 3 and 5. However, where the material of which said sleeves are formed is more rigid than that of the spring means disposed within said cavities the upper and lower cavity defining sleeves will be discreet from each other, as is shown in the embodiment of FIG. 3A, further described below.

It is to be understood that in a preferred embodiment, vertical sleeves 22/27 will be molded integrally with upper and lower rigid horizontal supports 16 and 24 respectively, such that the joinder of the sleeves 22 and 27 thereof will occur after resilient means 28 has been dropped into apertures 31 within upper rigid horizontal support plate 16 prior to adhesion or other securement of sole 12 to upper shoe portion 10 or, conversely, after said means have been dropped into apertures 32 within lower rigid plate 24. Thereafter, such apertures must be sealed it is, thereby, to be appreciated that any of a number of production techniques may be employed in order to secure resilient within its respective resilient sleeve 22/27. It is however anticipated that, in most production scenarios, insertion of said through the lower plate 24 will be a more practical strategy.

Figure 2:
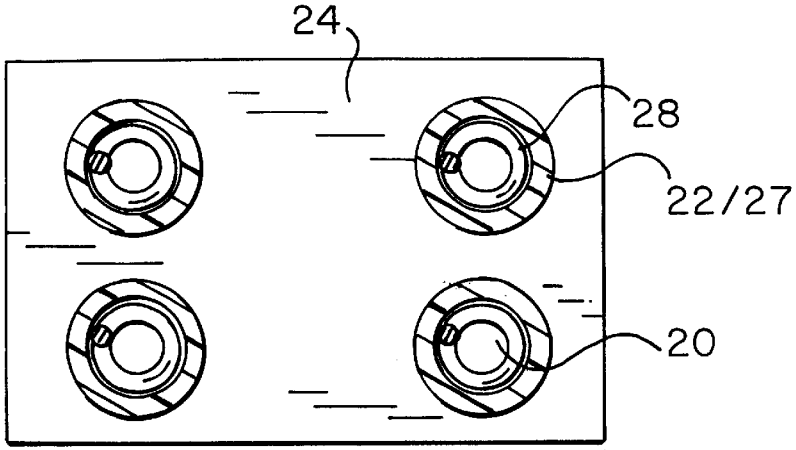
FIG. 2 is a horizontal cross-sectional view taken through Line 2—2 of FIG. 1.

In the horizontal cross-sectional view of FIG. 2 is shown lower support plate 24, integrated resilient sleeves 22 and 27, and resilient means 28 located within cavities 20. In the transverse vertical cross-sectional view of FIG. 3 are shown upper and lower support plates 18 and 24 respectively, said cavities 20, and the transverse horizontal chamber 16 defined by said upper and lower plates 18 and 24. The midsole 30 may also be seen in FIG. 3. In the embodiment of FIGS. 1–3, said resilient means comprises a metallic spring.

It is thereby to be appreciated that means 28 will compress responsive to downward forces originating from upper portion 10, that is, the heel of the foot of a user. In the embodiment of FIG. 3A, upper and lower sleeves 122 and 127 are more delineated in that, in this embodiment, said sleeves are formed of a material which is more rigid than that of spring 28. Accordingly, a gap 132 must be provided between said upper and lower sleeves to permit compression of spring 28 within the vertical cavities 20.

Figure 4:
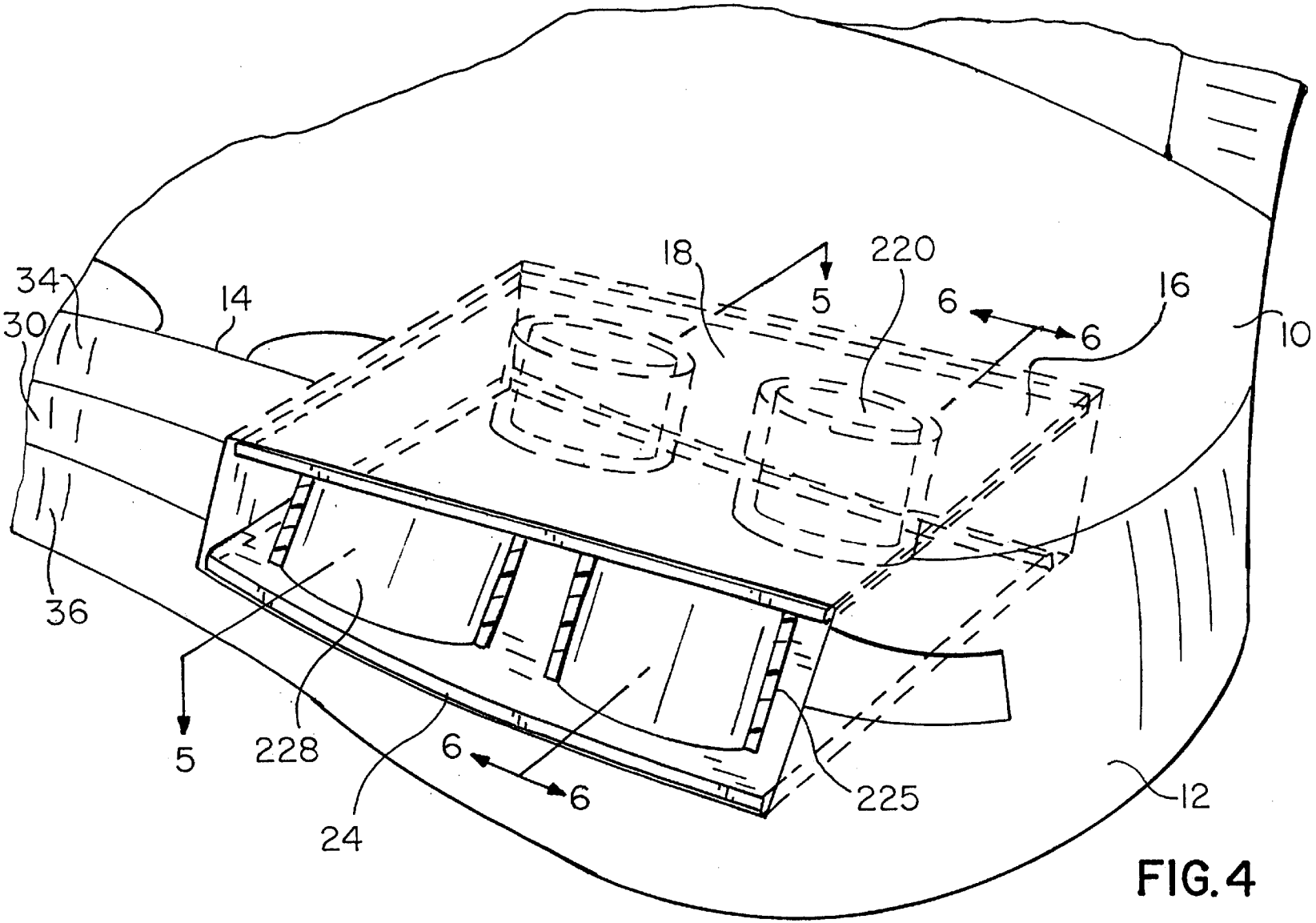
FIG. 4 is a breakaway schematic view of a second embodiment of the instant invention, using a solid resilient element in lieu of spring elements.

In the embodiment of FIG. 4, resilient means are expressed as cylinders of rubber 228, or a hard but resilient polymer, having a resiliency comparable to that of a spring of FIGS 1–3. Further, it has been found that such "rubber springs" in combination with upper and lower plates 18 and 24 respectively afford excellent stability to the foot, particularly when used with cavity-defining sleeves 225. The term "rubber spring" is defined as any element having a spring constant and spring rate greater than that of cavity defining sleeves 27 or 225. It is thereby to be appreciated that said sleeves 225 and the cavities 220 formed thereby thus serve to "lock" the spring means, whether they comprise metallic springs or "rubber springs," in place relative to upper and lower plates 18 and 24. It has more particularly been found that the use of said rigid upper and lower support plates 18 and 24 preclude side-to-side movement of the internal resilient elements without interfering with the cushioning of inner sole 34, midsole 30, lower sole 36, and heel portion 12 of the shoe. It has thereby been found that the use of plates 18 and 24 act to balance the upper shoe relative to the lower shoe in much the fashion that the body of an automobile is balanced upon its wheel assembly through the function of a vehicle chassis suspension. It has also been found that the weight of each plate can be as low as one ounce each such that, in combination with the resilient elements, as little as four ounces is added to an athletic shoe formed in accordance with the present invention.

It has also been found that the spring cushioning effect of the present system insulates the sole of the foot from shock otherwise transmitted through the sole components 34, 30, and 36 of the shoe itself, acting in much the fashion of a shock absorber in a vehicle. Resultingly, when walking or running with a shoe of the present type, energy impacting upon the lower sole 36 from the pavement will be transmitted upwardly through spring means 18 or 228 thereby providing an incremental uplift to one's walking, running or other activity. It has been further found that impact upon many parts of the body inclusive of the feet, knees, hips and spine are diminished through the shock absorbing effect of the internal spring or rubber cylinder assembly.

It has been additionally determined that the horizontal chamber 16 created by the horizontal plates 18 and 24 affords a most aesthetic appearing athletic shoe.

In the cross-sectional views taken along Lines 5—5 and 6—6 of FIG. 4 may be appreciated the geometry between the respective plates after the rubber cylinders 228 have been inserted.

Figure 6:
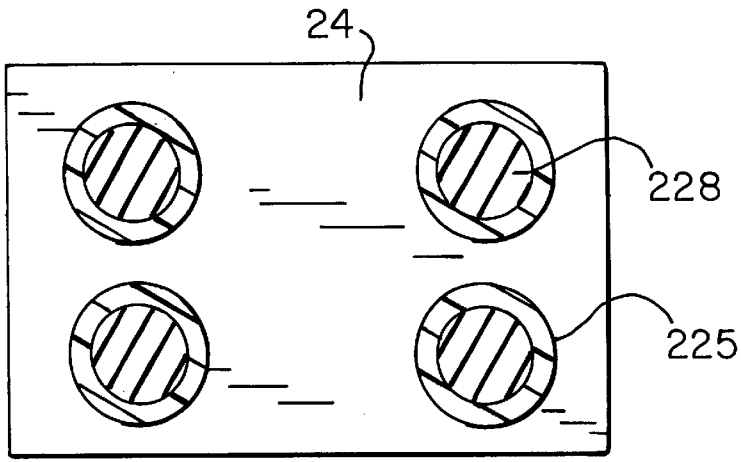
FIG. 6 is a horizontal cross-sectional view taken through Line 6—6 of FIG. 4.
Figure 7:
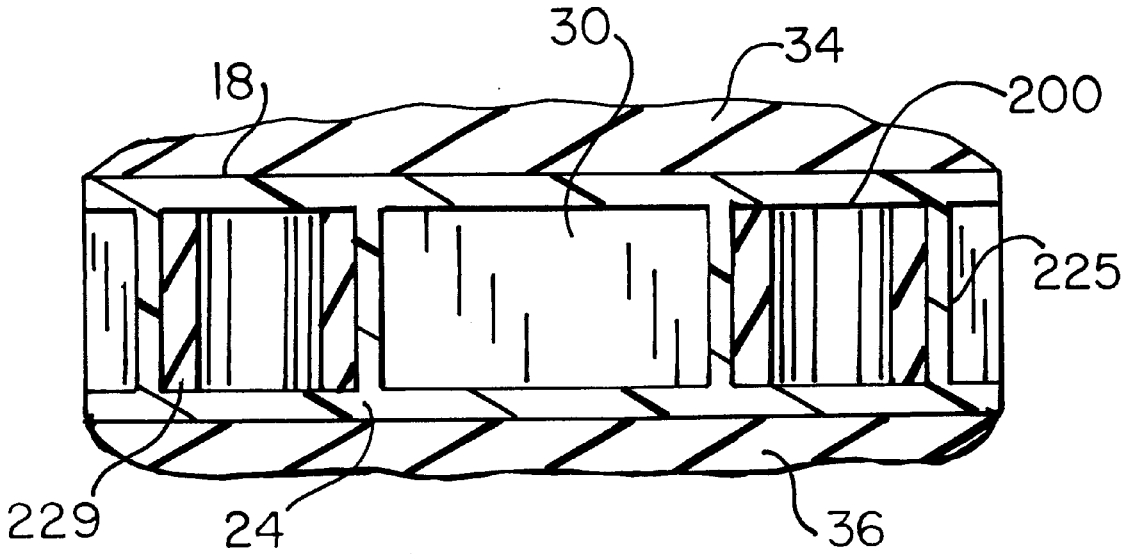
FIGS. 7 and 8 are respective vertical and horizontal cross-sectional views of a variation of the embodiment of FIGS. 4 to 6 in which a hollow resilient element is substituted for a solid resilient element.
Figure 8:
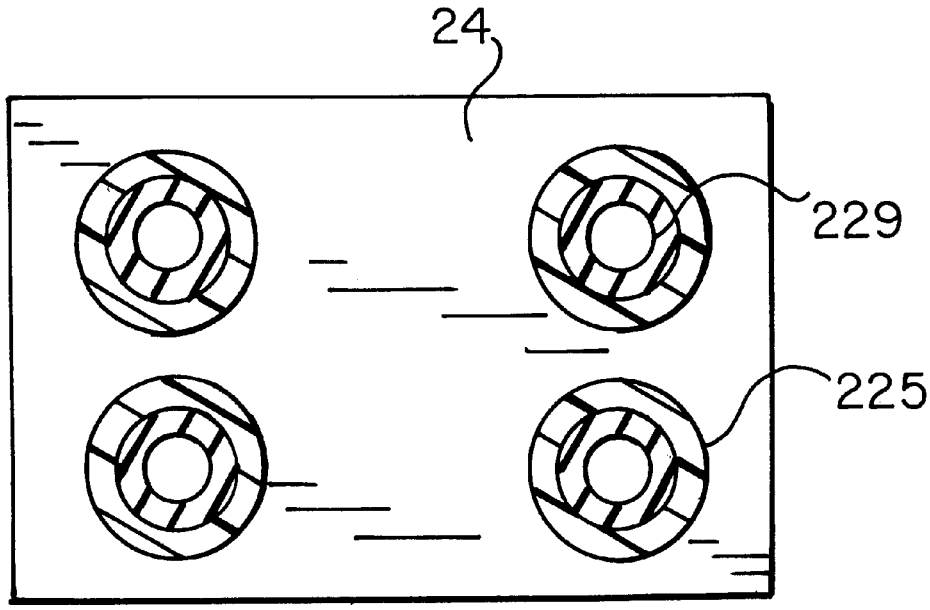

In FIGS. 7 and 8 are shown a variation of the embodiment of FIGS. 4 to 6 in which the radial cross-section of each rubber or polymeric cylinder 229 defines a hollow sleeve having an annular geometry within each sleeve 225. Thereby, the function of the cylinder as a spring is more clearly replicated, this subject to a sufficient radial annulus, and choice of material, of the cylinder 229, in which its spring constant and spring rate exceed that of sleeve 225.

Figure 10:
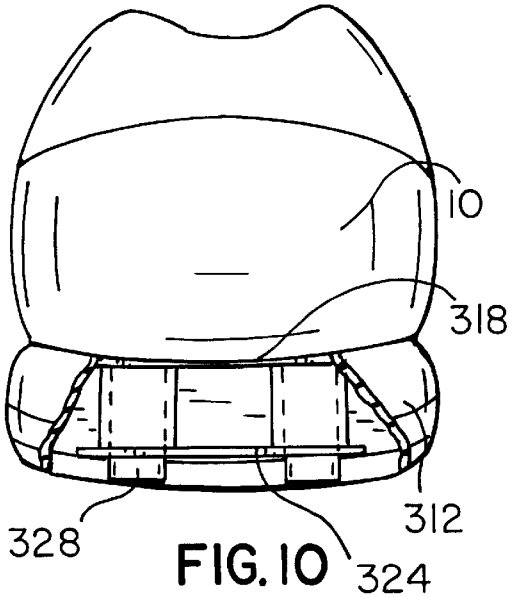
FIG. 10 is a rear breakaway view of the embodiment of FIG. 9.
Figure 9:
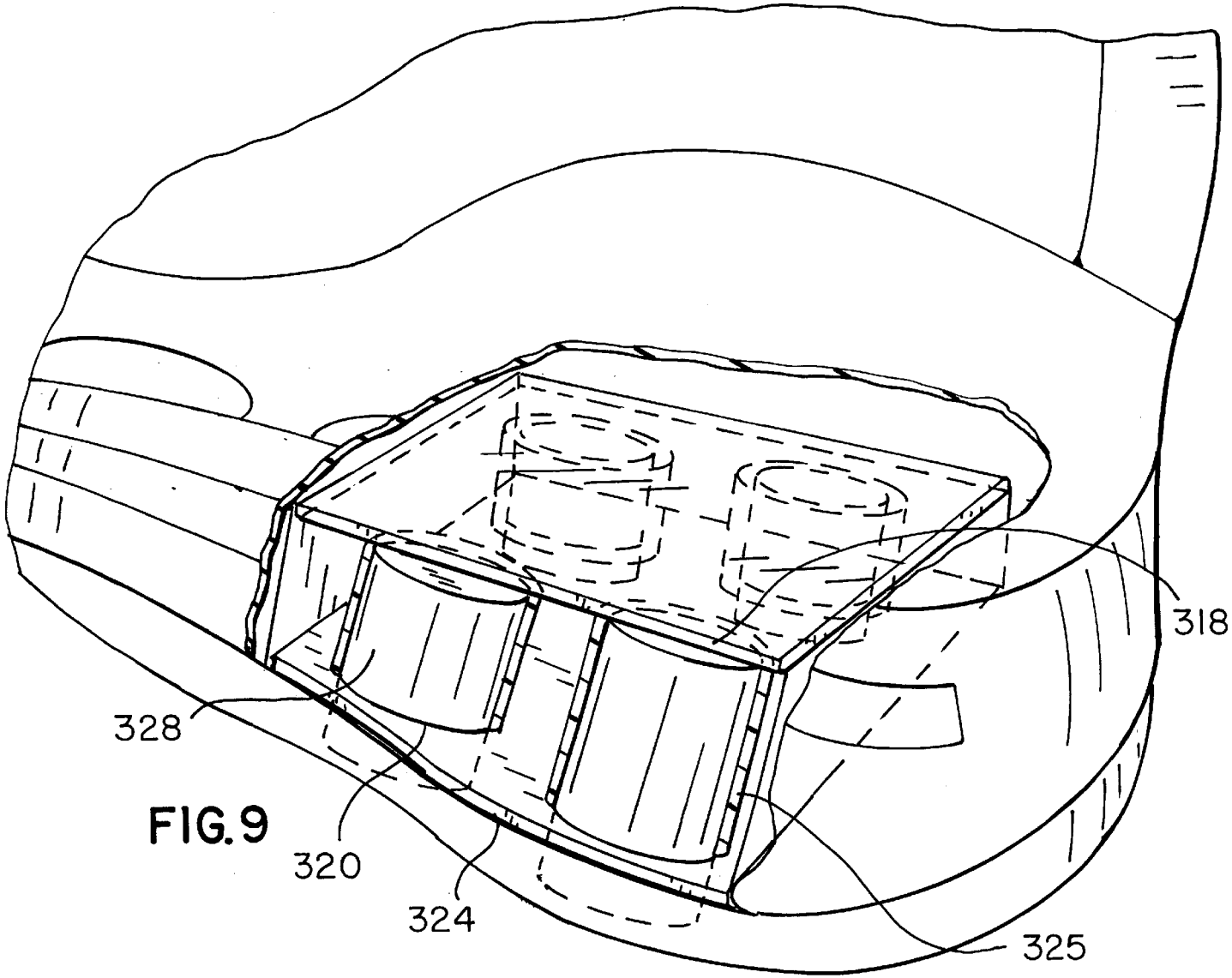
FIG. 9 is a breakaway schematic view of a further embodiment of the invention, generally similar to the embodiment of FIGS. 4 to 6 in which each of the resilient internal rubber elements thereof extends through the lower platform and to the external outersole of the shoe.

In the embodiment of FIGS. 9 and 10 is shown a variation of the embodiment of FIGS. 4 thru 6 wherein there are provided rubber cylinders 328 which extend through apertures 320 within lower plate 324, this as may be more fully seen in the rear breakaway view of FIG. 10. In this embodiment, elongate rubber cylinder 328 impact directly upon the floor or pavement but are still stabilized by the action of upper and lower plates 318 and 324 respectively. Further, rubber springs 328 are stabilized relative to the upper and lower plates by vertical sleeves 325.

Figure 11:
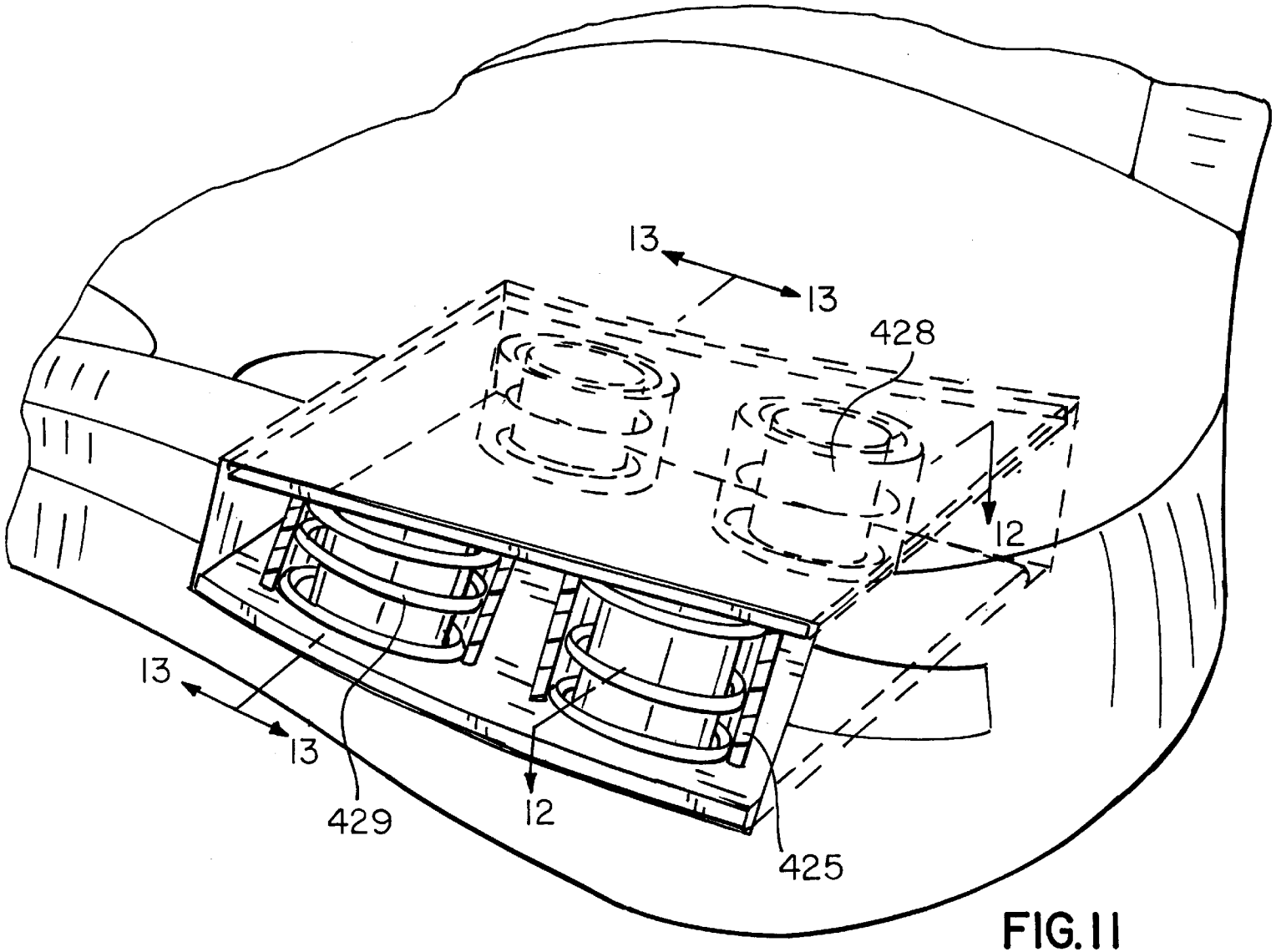
FIG. 11 is a breakaway schematic view of a further embodiment in which resilient elements are used within spring elements internally to the resilient vertical columns of the system.
Figure 12:
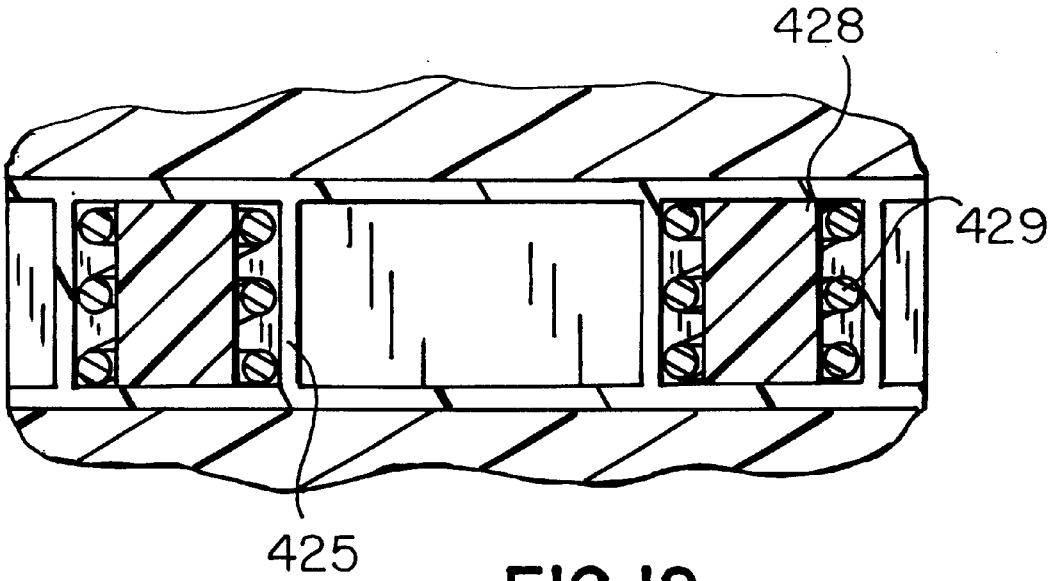
FIG. 12 is a vertical cross-sectional view taken along Line 12—12 of FIG. 11.
Figure 13:
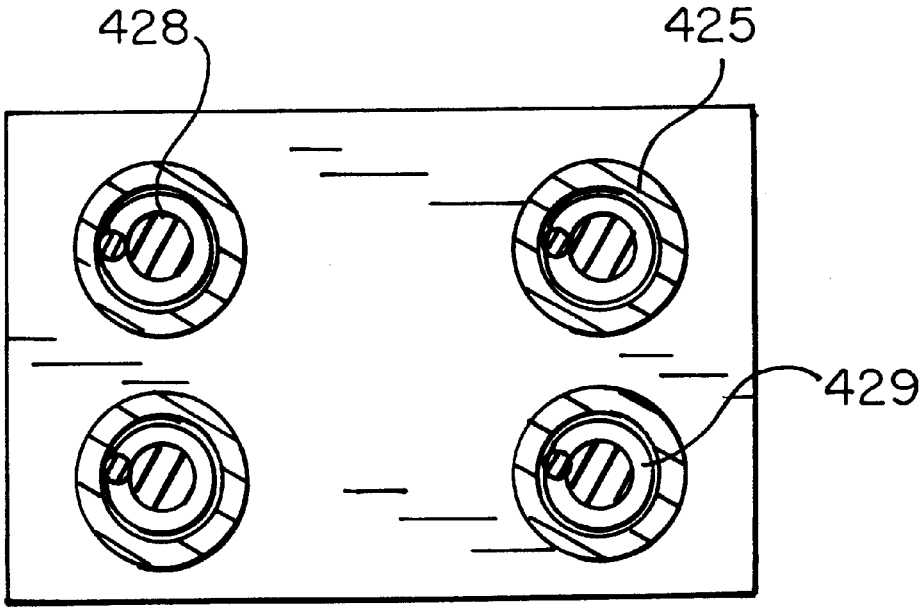
FIG. 13 is a horizontal cross-sectional view taken along Line 13—13 of FIG. 11.

As may be noted in FIGS. 11–13, resilient cylinders 428 may be placed within metallic spring 429 and within integral sleeves 425.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

Having thus described my invention what I claim as new, useful and non-obvious and, accordingly, secure by Letters Patent of the United States is:

1. An athletic shoe having a substantially horizontal chamber substantially within a heel portion of a mid-sole thereof, said chamber having atmospheric communication at lateral sides thereof, the chamber comprising:

(a) an upper substantially rigid horizontal support plate having a plurality of transverse downwardly directed resilient cavities therein, each of said cavities defined by an upper resilient sleeve;

(b) a lower substantially rigid horizontal support plate having a corresponding plurality of upwardly directed resilient cavities therein, each of said cavities defined by a lower resilient sleeve in which each opposing pair of said vertical cavities comprises respective portions of a single circumferential resilient sleeve defining an integration of said upper and lower sleeves; and (c) a plurality of resilient means disposed within an aggregate length of each opposing pair of said upper and lower cavities, said resilient means comprising a cylindrical body of a solid resilient material, said cylindrical body extending downwardly through said lower plate to a bottommost surface of an outer sole of said shoe, said resilient means each having a greater spring rate and spring constant than that of said resilient sleeve.

2. The athletic shoe as recited in claim 1 further comprising a metallic spiral spring disposed circumferentially about said solid cylindrical body.

3. An athletic shoe having a substantially horizontally chamber substantially within a heel portion of a mid sole thereof, said chamber having atmospheric communication at lateral sides thereof, said chamber comprising:

(a) an upper substantially rigid horizontal support plate;

(b) a lower substantially rigid horizontal support plate having a plurality of at least four apertures therein;

(c) flexible resilient unitary sleeves integrally joining said apertures of said lower plate to opposing surfaces of said upper plate; and (d) resilient means each comprising a cylindrical body of a resilient material extending from said upper plate and downwardly through said lower plate to a bottommost surface of an outer sole of shoe, said resilient means each having a spring constant and spring rate greater than that of said sleeves.

4. The athletic shoe as recited in claim 3, in which said cylindrical body includes a hollow annular cross-section.

5. The athletic shoe as recited in claim 3, further comprising a metallic spring disposed outwardly of said cylindrical body and inwardly of said unitary sleeves.

* * * * *